United States Patent [19]

Sakaguchi et al.

[11] Patent Number: 4,478,871

[45] Date of Patent: Oct. 23, 1984

[54] METHOD FOR HARDFACING A FERROUS BASE MATERIAL

[75] Inventors: Shigeya Sakaguchi; Masaharu Shiroyama; Hiroshi Ito, all of Fukuoka, Japan

[73] Assignee: Nippon Tungsten Co., Ltd., Fukuoka, Japan

[21] Appl. No.: 563,544

[22] Filed: Dec. 20, 1983

Related U.S. Application Data

[63] Continuation of Ser. No. 358,749, Mar. 16, 1982, abandoned.

[30] Foreign Application Priority Data

Mar. 23, 1981 [JP] Japan ..... 56-42750

[51] Int. Cl.[3] ..... B05D 1/06; B05D 1/10

[52] U.S. Cl. ..... 427/34; 427/423; 428/570; 428/937; 75/251

[58] Field of Search ..... 428/478, 570, 937; 75/251, 252; 427/34, 423

[56] References Cited

U.S. PATENT DOCUMENTS 3,974,245 8/1976 Cheney et al. ..... 75/0.5 BA 4,025,334 5/1977 Cheney et al. ..... 75/0.5 AC 4,173,685 11/1979 Weatherly ..... 427/34 X

FOREIGN PATENT DOCUMENTS 659644 3/1963 Canada ..... 427/423

*Primary Examiner*—Shrive P. Beck

*Attorney, Agent, or Firm*—Jordan and Hamburg

[57] ABSTRACT

Tungsten carbide and nickel-phosphorus alloy coexist in individual particles. The composite powder produced by a mechanical mix of these two substances consists of 30~95 percent by weight of tungsten carbide and valanced nickel-phosphorus alloy. This powder is sprayed to the ferrous base material, resulting in a uniform dispersion of both tungsten carbide and nickel-phosphorus, causing tight adhesion to the surface because the tungsten carbide and nickel-phosphorus alloy coexist in individual particles in the composite. A hard metal coating is produced having high hardness and excellent wear resistance, after the surface of the hard metal coating is heated and the high temperature of the nickel-phosphorus alloy causes a liquid phase under the condition of a nonoxidizing atmosphere. This hard metal coating is used for various kinds of the wear-resistant materials.

11 Claims, 1 Drawing Figure

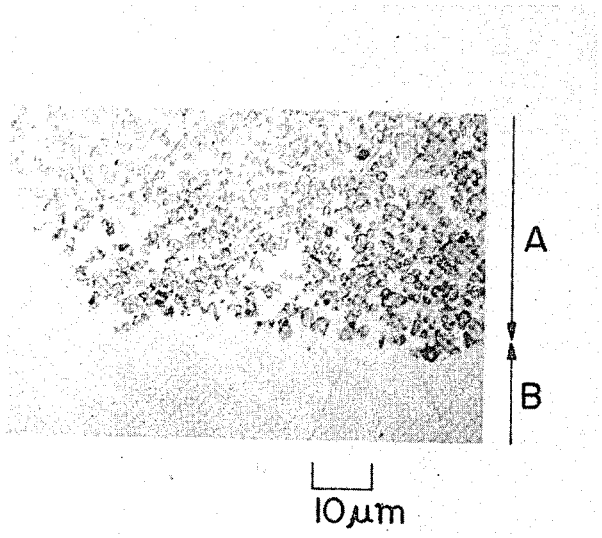
A
B
10μm

METHOD FOR HARDFACING A FERROUS BASE MATERIAL

This application is a continuation of application Ser. No. 358,749, filed Mar. 16, 1982 and now abandoned.

BACKGROUND OF THE INVENTION

This invention relates to a method for hardfacing which is required to provide wear resistance for a mechanical seal ring or a roll etc. consisting of a ferrous base material. WC is generally used a method for hardfacing ferrous base materials. Various kinds of metal products are sprayed with WC by plasma spraying, wire explosion spraying, or a detonation gun process etc., and there is formed a hard metal coating on the surface of a metal product because WC has a high hardness. In this case, it is difficult to spray using only WC because of its high melting point, so that in most cases in which it is used, the material is bonded by WC powder and Co or Ni bonding materials. However, in the case of using Co or Ni to WC powder as the bonding material, it is difficult to avoid a considerable amount of pores on the sprayed coating even if it is used with various kinds of spraying methods. Also the adhesion strength for the base material is low, in the order of 400~800 Kg/cm$^2$, therefore it is difficult to stand up in use under the condition of high loading, and there are further defects in that it causes cracking. Accordingly, a composite powder consisting of WC and Ni-P alloy was developed in Japan and applied for the purpose of overcoming the above-mentioned defects (Japanese Patent Application No. 55602 of 1980).

In the case of utilizing a sprayed coating using the composite spraying powder of WC and Ni-P alloy by plasma spraying, the porosity of the sprayed coating is less than 1% and the adhesion strength for the ferrous base material may obtain a strength of more than 800 Kg/cm$^2$. However, the requirement of a coating which has high-density and high strength practicality is still not satisfied. Alternatively, Japanese Patent Publication No. 42854 of 1979 describes a method for the material bonding of WC powder with Co or Ni which has also the above-mentioned defects. This Japanese Pat. No. 42854 is a method for hardfacing by mechanically mixing WC powder with Ni-P alloy powder, spraying it on the surface of a base material, and heating the sprayed base material. In this method, WC is a carbide of high melting point and Ni-P alloy is a soldering material of low melting point. The defects in this method are that Ni-P is on alloy of low melting point and therefore is preferentially sprayed and adheres easily, and WC powder has a high specific gravity so that it sediments easily. Therefore, during the mixture of WC powder and Ni-P alloy, the powder remains in the container of the spraying apparatus, and the mixture becomes nonuniform. For these reasons, there are defects that occur with the usage of this patent, which include: the structure of a sprayed coating has the tendency to become nonuniform, and the spray coating may become porous even after heating if the grain boundaries of a sprayed particle have a lot of crevices.

SUMMARY OF THE INVENTION

The objective of the present invention is to provide a a method for the tight adhesion of a minute and tough wear-resistant coating to a ferrous base material. This is accomplished by using a method in which WC and Ni-P alloy coexist in individual particles and the composite spraying material consisting of 30~95 percent by weight of WC and the balanoe. A Ni-P alloy is sprayed on the ferrous base material; the ferrous base material is then heated until the temperature at which the Ni-P alloy melts under the condition of nonoxidizing atmosphere. This ferrous base material, having a wear-resistant coating on its surface obtained by the method of the present invention, may be used in many cases where a wear-resistant base material is needed. An example would be a mechanical seal ring of a roll etc.

BRIEF DESCRIPTION OF DRAWING

The FIGURE shows a photomicrograph of a cross-sectional view of the surface of steel which has a hard metal coating obtained by the method of the present invention. The magnification of the photomicrograph is 1000.

DESCRIPTION OF THE PREFERRED EMBODIMENTS

In the present invention, WC and Ni-P alloy coexist in individual particles, and the composite spraying material consisting of 30~95 percent by weight of WC and the balance. A Ni-P alloy is sprayed on the ferrous base material. The ferrous base material is then heated until the temperature of the above-mentioned Ni-P alloy causes liquidification of the composite under the condition of a nonoxidizing atmosphere. This is the method provided by the present invention for hardfacing ferrous base material. In the present invention, WC and Ni-P alloy are not merely mixed mechanically, but also combined in a composite powder in which they coexist in individual particles. Therefore, both WC and Ni-P alloy are sprayed uniformly. Because this method provides for the uniform dispersement of the WC and Ni-P alloy, crevices are not likely to occur in the sprayed coating, enabling a minute hard metal coating to be produced which does not form pores when heated for densification. Additionally, the reason for limiting the WC content to 30~95 percent by weight in the composite powder consisting of WC and Ni-P alloy was confirmed from the results of much experimentation. In the case of a WC content of less than 30 percent by weight the hardness of the sprayed coating becomes under 600 Kg/mm$^2$, and therefore, the advantages of a high degree of hardness and wear resistance, which are characteristic of WC base material are lost. Alternatively, in using a composite with more than 95 percent by weight of WC, a hard metal coating which forms a lot of pores is produced, and there is difficulty in obtaining a minute coating. Also, the adhesion strength of the hard metal coating to the ferrous base material becomes remarkably lowered to 300 Kg/cm$^2$. The practical example of the present invention is shown in the following example.

WC powder under 200 mesh and Ni-P alloy powder were mixed in a ratio of 70:30 by weight. A green compact substance was obtained by placing the mixed powder under a pressure of 300 Kg/cm$^2$. This green compact substance was further heated in an electric furnace for 1 hour at a temperature of 880° C. in a hydrogen atmosphere, becoming a sintered body. This sintered body was further ground and screened and a powder of coexisting individual particles of WC and Ni-P alloy between 200 mesh and 400 mesh was obtained. This powder was sprayed to the surface of a steel (a mild steel) base plate using a plasma spraying method which employs argon gas as arc gas and powder transforming gas. After a thickness of 300 μm of coating was achieved, the sprayed steel base material was heated at a temperature of 1100° C. for 30 minutes under a hydrogen atmosphere in an electric furnace. Upon microscopic examination of the sprayed steel base material, a hard metal coating without pores was revealed. The results of an X-ray diffraction analysis of the steel base material, show the hard metal coating after the heat treatment was composed of three phases: WC, $W_3Ni_3C(\eta)$ and (Ni-P)-WC solid solution. The photomicrograph showing a cross-sectional view of the hard metal coating which was obtained in the above-mentioned method is shown in the FIGURE. A in the FIGURE is the hard metal coating, and B in the FIGURE is the steel base material. The microstructure of the hard metal coating shown in the photomicrograph confirms that it is a minute hard metal coating without pores. The results of a comparative test of the hard metal coating obtained in the above practical example with a plasma sprayed coating consisting of WC and 30 percent by weight of Co, and a plasma sprayed coating consisting of WC and Ni-P alloy in a mechanical mix, and heat treated at a temperature of 1100° C. for 30 minutes, are shown in the following table.

| | WC - 30C.° | the mixing powder of WC powder and Ni-P alloy powder (a ratio of mixture 70:30) | the present invention |
|---|---|---|---|
| adhesion strength ($Kg/cm^2$) | 510 | over 1500 | over 1500 |
| shear strength of the coating ($Kg/cm^2$) | 620 | over 2000 | over 2000 |
| porosity (%) | over 10 | 5~10 | non-pore |
| micro Vickers hardness ($Kg/mm^2$) | 690~970 | 330~790 | 1050~1150 |

In the hard metal coating which was obtained in the practical example of the present invention, the hardness is remarkably greater than the other two comparative examples, and the adhesion strength to the base material and the strength of coating itself are also greater, as well as the coating being sufficiently minute in the present invention. Additionally, the necessary heating of the sprayed coating may be performed in a vacuum, and alternatively, a nitrogen atmosphere may be substituted for the hydrogen atmosphere used in the practical example. As mentioned above, the present invention provides for a sprayed hard metal coating with minutely dispersed WC and Ni-P alloy because the composite material is comprised of WC coexisting with Ni-P alloy. WC, with its high degree of hardness and wear resistance as the spraying material, and Ni-P alloy as its bonding material, produces an excellent wear-resistant hard metal coating which bonds tightly to ferrous base materials. It is liberally used on mechanical constructing materials which require high wear resistance, for example, a mechanical seal ring or a roll etc.

What we claim is:

1. A method for hardfacing ferrous base material comprising the combination of steps of: mechanically mixing tungsten carbide powder and a nickel-phosphorous alloy with the mixture comprising 30–95 percent by weight of tungsten carbide with the balance being said alloy; compressing said mixture, heating said mixture to form a sintered body, forming a composite powder from said sintered body, said powder consisting of individual particles of WC and Ni-P alloy of between 200 and 400 mesh in size, spraying said composite powder onto the surface of a ferrous base material, heating said sprayed ferrous base material in a non-oxidizing atmosphere until a liquid phase forms on said material which constitutes a wear-resistant coating thereon; said coating consisting of WC, $W_3Ni_3C(\eta)$ and (Ni-P)-WC solid solution.

2. A method according to claim 1, wherein said tungsten carbide powder is under 200 mesh.

3. A method according to claim 2, wherein said mixture of tungsten carbide and nickel-phosphorous alloy is compressed under a pressure of about 300 $Kg/cm^2$.

4. A method according to claim 1, wherein said heating of said mixture to form said sintered body is effected at a temperature of about 880° C. in a hydrogen atmosphere for about one hour.

5. A method according to claim 1 further comprising grinding and screening said sintered body to obtain said composite powder.

6. A method according to claim 1, wherein said spraying of said composite powder onto the surface of said ferrous base material comprises using a plasma spraying method employing argon gas as an arc gas and powder transforming gas.

7. A method according to claim 6 further comprising spraying said ferrous base material with 300 μm of said composite powder.

8. A method according to claim 1, wherein said heating of said sprayed ferrous base material is effected at a temperature of about 1100° C. for about 30 minutes in a nonoxidizing atmosphere.

9. A method according to claim 8, wherein said heating of said sprayed ferrous base material is effected in a hydrogen atmosphere.

10. A method according to claim 8, wherein said heating of said sprayed ferrous base material is effected in a nitrogen atmosphere.

11. A method according to claim 8, wherein said heating of said sprayed ferrous base material is effected in a vacuum.

* * * * *